US010471327B1

(12) United States Patent
Imahata

(10) Patent No.: US 10,471,327 B1
(45) Date of Patent: Nov. 12, 2019

(54) SWING PRACTICE APPARATUS

(71) Applicant: Takeo Imahata, Colfax, CA (US)

(72) Inventor: Takeo Imahata, Colfax, CA (US)

( * ) Notice: Subject to any disclaimer, the term of this patent is extended or adjusted under 35 U.S.C. 154(b) by 0 days.

(21) Appl. No.: 16/011,405

(22) Filed: Jun. 18, 2018

(51) Int. Cl.

| | |
|---|---|
| ***A63B 69/00*** | (2006.01) |
| *A63B 102/18* | (2015.01) |
| *A63B 102/02* | (2015.01) |
| *A63B 102/20* | (2015.01) |
| *A63B 43/00* | (2006.01) |
| *A63B 69/20* | (2006.01) |

(52) U.S. Cl.
CPC ..... *A63B 69/0091* (2013.01); *A63B 69/0002* (2013.01); *A63B 69/0084* (2013.01); *A63B 43/007* (2013.01); *A63B 69/206* (2013.01); *A63B 2069/0008* (2013.01); *A63B 2102/02* (2015.10); *A63B 2102/18* (2015.10); *A63B 2102/20* (2015.10); *A63B 2225/093* (2013.01)

(58) Field of Classification Search
CPC ..... A63B 69/0091; A63B 69/0002; A63B 69/0084; A63B 2102/02; A63B 2069/0008; A63B 2225/093; A63B 67/10; A63B 69/206; A63B 69/00; A63B 69/0075; F41J 9/02
USPC ..... 473/422–430, 451, 417; 273/359
See application file for complete search history.

(56) References Cited

U.S. PATENT DOCUMENTS

| | | | | | |
|---|---|---|---|---|---|
| 495,371 | A * | 4/1893 | Rice | F41J 9/02 | 273/369 |
| 650,008 | A * | 5/1900 | Hamel | F41J 9/02 | 273/359 |
| 1,554,409 | A * | 9/1925 | Coffee | A63B 69/206 | 473/426 |
| 2,680,022 | A * | 6/1954 | Walden | A63B 69/0084 | 473/147 |
| 3,086,775 | A * | 4/1963 | Albert | A63B 69/0084 | 473/428 |
| 3,469,840 | A * | 9/1969 | Kruzel | A63B 69/0084 | 473/428 |
| 3,471,153 | A * | 10/1969 | Baumler | F41J 9/02 | 273/359 |
| 3,558,134 | A * | 1/1971 | Hoitsma | A63B 69/0075 | 473/428 |
| 3,630,521 | A | 12/1971 | Lingbeek | | |
| 3,703,286 | A * | 11/1972 | Adkin | A63B 69/0084 | 473/428 |
| 3,754,761 | A * | 8/1973 | Pruss | A63B 69/0084 | 473/139 |

(Continued)

*Primary Examiner* — Mitra Aryanpour
(74) *Attorney, Agent, or Firm* — Muramatsu & Associates

(57) ABSTRACT

A swing practice apparatus has an upper horizontal bar, a lower horizontal bar that is positioned directly under the upper horizontal bar and runs parallel with the upper horizontal bar, an upper slide ring capable of sliding along the upper horizontal bar, a lower slide ring capable of sliding along the lower horizontal bar, and a spring that exserts force to the ball toward a catcher side. A ball is supported from the upper and the lower slide rings via support springs, and positioned between the upper horizontal bar and the lower horizontal bar. A stopper is mounted at a pitcher side of the upper horizontal bar to stop the upper slide ring, and a release mechanism releases the stopper to release the upper slide ring from the stopper and the upper slide ring and the ball move toward the catcher side due to the spring.

11 Claims, 10 Drawing Sheets

(56) References Cited

U.S. PATENT DOCUMENTS

| | | | | | |
|---|---|---|---|---|---|
| 3,924,855 | A * | 12/1975 | Pretorius | A63B 69/0084 | 473/575 |
| 3,953,028 | A * | 4/1976 | Gowins | A63B 69/0002 | 473/428 |
| 4,027,880 | A * | 6/1977 | Hadtke | A63B 43/007 | 473/426 |
| 4,138,107 | A * | 2/1979 | Janis | A63B 69/0084 | 473/426 |
| 4,342,459 | A * | 8/1982 | Pretorius | A63B 69/0084 | 473/428 |
| 4,521,016 | A * | 6/1985 | Tominaga | A63B 69/0084 | 473/430 |
| 4,944,513 | A | 7/1990 | Zentner | | |
| 5,413,347 | A * | 5/1995 | Prater | A63B 69/0084 | 473/147 |
| 5,611,539 | A * | 3/1997 | Watterson | A63B 61/02 | 473/428 |
| 6,033,323 | A * | 3/2000 | McCown | A63B 69/0088 | 473/423 |
| 6,821,216 | B1 * | 11/2004 | Van Asselt | A63B 69/0024 | 473/422 |
| 7,033,290 | B1 * | 4/2006 | Coldren | A63B 69/0002 | 473/422 |
| 8,074,994 | B1 * | 12/2011 | Delphia | F41J 7/02 | 273/406 |
| 9,314,681 | B2 * | 4/2016 | Palardis | A63B 69/0002 | |
| 9,486,682 | B2 * | 11/2016 | Daugard | A63B 69/0088 | |
| 9,889,360 | B1 | 2/2018 | Wilson | | |
| 2004/0033848 | A1 * | 2/2004 | Bragg | A63B 69/0002 | 473/423 |
| 2012/0238382 | A1 * | 9/2012 | Allison | A63B 67/10 | 473/428 |
| 2013/0116068 | A1 * | 5/2013 | Traynor | A63B 69/0002 | 473/428 |

* cited by examiner

SWING PRACTICE APPARATUS

FIELD OF THE INVENTION

This invention relates to a swing practice apparatus, and more particularly to a swing practice apparatus for baseball or tennis etc., that utilizes a ball suspended to travel back or forth, between two vertically spaced members, and a stopper that stops the ball at one end, and a string that stores mechanical energy to be released by a stopper for swing practice.

BACKGROUND OF THE INVENTION

Sport players, such as baseball players, tennis players, etc., would like to have the opportunity for more frequent practice in developing a proper stroke with use of a bat or a racket, etc. Since hitting a baseball results in the baseball traveling an extended distance, baseball players often go to a facility such as a baseball practice range to practice their stroke, which is inconvenient for reasons such as the time required to get there, delays due to increased overcrowding, and the cost of using the facility.

Various devices have been developed which hold the baseball at a predetermined initial position to be hit by a baseball bat. For efficient practicing of swings, it is desired that the user is able to practice continuously. It is further desired that the user is able to acquire a good sense of timing for hitting the ball. It is further desired that those functionalities be achieved with a simple structure to reduce cost and improve reliability.

SUMMARY OF THE INVENTION

It is, therefore, an object of the present invention to provide a swing practice apparatus that is reliable and low cost with a simple structure so that the user can practice swing of a bat or racket repeatedly with high efficiency.

In the present invention, a swing practice includes: an upper horizontal bar; a lower horizontal bar that is positioned directly under the upper horizontal bar and runs parallel with the upper horizontal bar; an upper slide ring capable of sliding along the upper horizontal bar; a lower slide ring capable of sliding along the lower horizontal bar; a ball supported from the upper slide ring and the lower slide ring via support springs, and positioned between the upper horizontal bar and the lower horizontal bar; a spring that exserts force to the ball toward a catcher side; a stopper mounted at a pitcher side of the upper horizontal bar to stop the upper slide ring; and a release mechanism to release the stopper which causes the upper slide ring to be released from the stopper and the upper slide ring and the ball to move toward the catcher side due to the spring; where the pitcher side refers to the side toward which the baseball is hit and the catcher side refers to the opposite side.

The swing practice apparatus of the present invention further includes a pole connected to one end of the upper horizontal bar and the lower horizontal bar, and an opposing pole connected to the other end of the upper horizontal bar and the lower horizontal bar.

In the swing practice apparatus of the present invention, the ball is supported by a string extended from the upper slide ring and a string extended from the lower slide ring. Preferably, the ball is supported by two lines of strings extended from the upper slide ring and two lines of strings extended from the lower slide ring.

In the swing practice apparatus of the present invention, the spring is a tension spring. Alternatively, the spring is a compression spring.

In the swing practice apparatus of the present invention, the stopper is configured by: a base pole that stands vertically and attaches to the upper horizontal bar; an arm swingably connected to the base pole with a support shaft as an axis; a rotatable roller provided at an end of the arm; a stopper protrusion protruding at a bottom near the roller of the arm; and an arm spring connected to the arm and pulls the arm downward; where the stopper protrusion hooks the upper slide ring to stop the ball.

The swing practice apparatus of the present invention further includes a release mechanism to release the stopper that enables the ball to move to the catcher side.

In the swing practice apparatus of the present invention, the release mechanism is a mechanical foot pedal having a foot pedal-actuated cable that pulls the arm of the stopper.

The swing practice apparatus of the present invention further includes a counter having a button and a display, where the button is activated in response to the arm of the stopper to count the number of hitting the ball.

The swing practice apparatus of the present invention further includes: an upper pivot arm connected at a pitcher side of the upper horizontal arm; and a lower pivot arm connected at a pitcher side of the lower horizontal arm, where the upper pivot arm and the lower pivot arm are rotatable along a horizontal plane.

DETAILED DESCRIPTION OF THE PREFERRED EMBODIMENTS

Figure 1A:
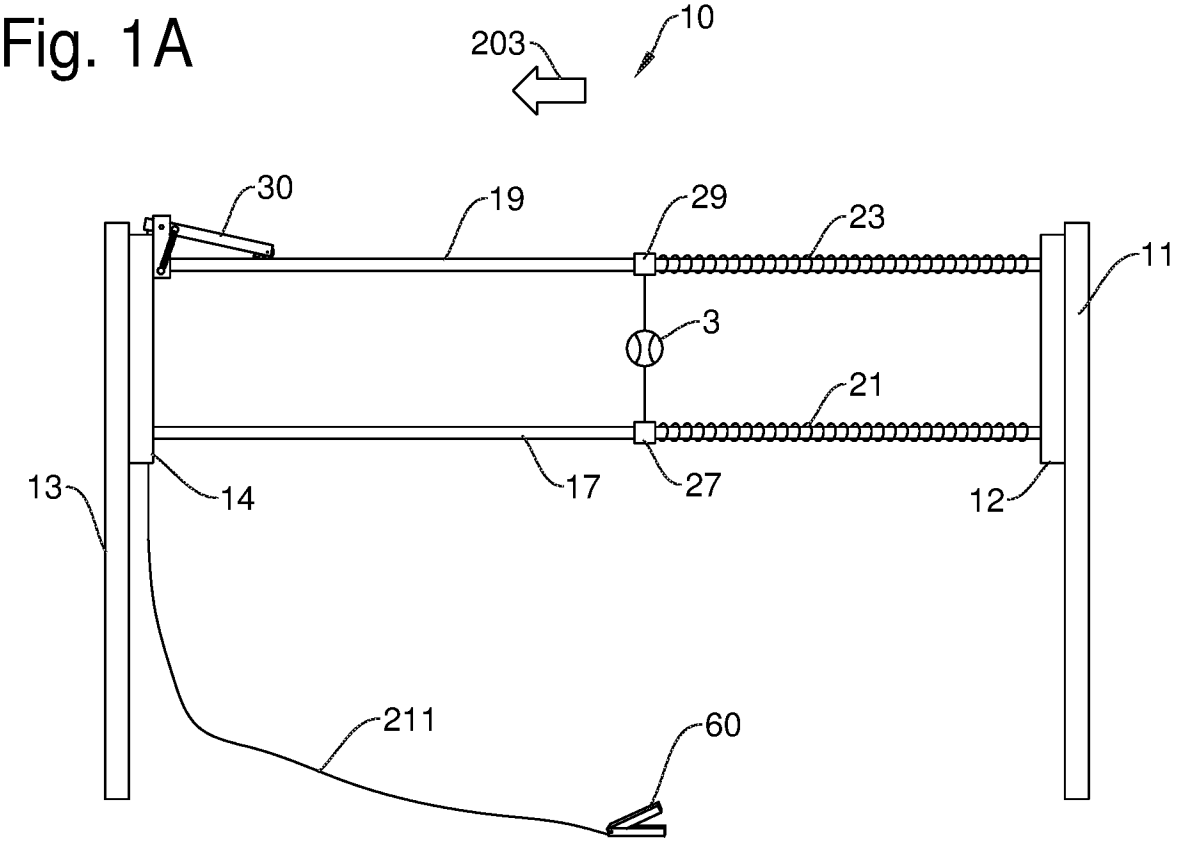
FIG. 1A is a side view showing a swing practice apparatus of the present invention where a baseball is positioned at an initial position.

The present invention will be described in detail with reference to the accompanying drawings. FIG. 1A is a side view showing a swing practice apparatus 10 of the present invention where a baseball 3 is positioned at an initial position. The initial position refers to the position where the baseball 3 is ready to be hit by a baseball bat. While the baseball 3 is used throughout the specification, other balls suited for other sports, such as tennis or cricket, may also be used for the swing practice apparatus 10 of the present invention to hit the ball by a racket, etc. An arrow 203 in FIG. 1A indicates the direction to which the baseball will be hit. In the side view shown in FIG. 1A, the user hits the baseball to the left direction. The side toward which the baseball is hit is referred to as a pitcher side, which corresponds to the left side in FIG. 1A. The opposing side of the pitcher side is referred to as a catcher side, which corresponds to the right side in FIG. 1A.

Poles 11 and 13 are arranged to stand vertically. An upper horizontal bar 19 and a lower horizontal bar 17 run substantially parallel with each other and connect to the poles 11 and 13 via attachment portions 12. The lower horizontal bar 17 is positioned directly under the upper horizontal bar 19. The width between the upper horizontal bar 19 and the lower horizontal bar 17 is set to be suitable for hitting the baseball 3, for instance, between 10 to 25 inches. The upper horizontal bar 19 and the lower horizontal bar 17 may be made of steel pipes.

The baseball 3 is positioned between the upper horizontal bar 19 and the lower horizontal bar 17. An upper slide ring 29 is slidably moveable along the upper horizontal bar 19, and a lower slide ring 27 is slidably moveable along the upper horizontal bar 17. Both the upper slider ring 29 and the lower slide ring may have a bearing mechanism to reduce friction and allow smooth sliding movement. The baseball 3 is connected to the upper slide ring 29 and the lower slide ring 27 by a connection means, such as a string, as will be described later.

Figure 1B:
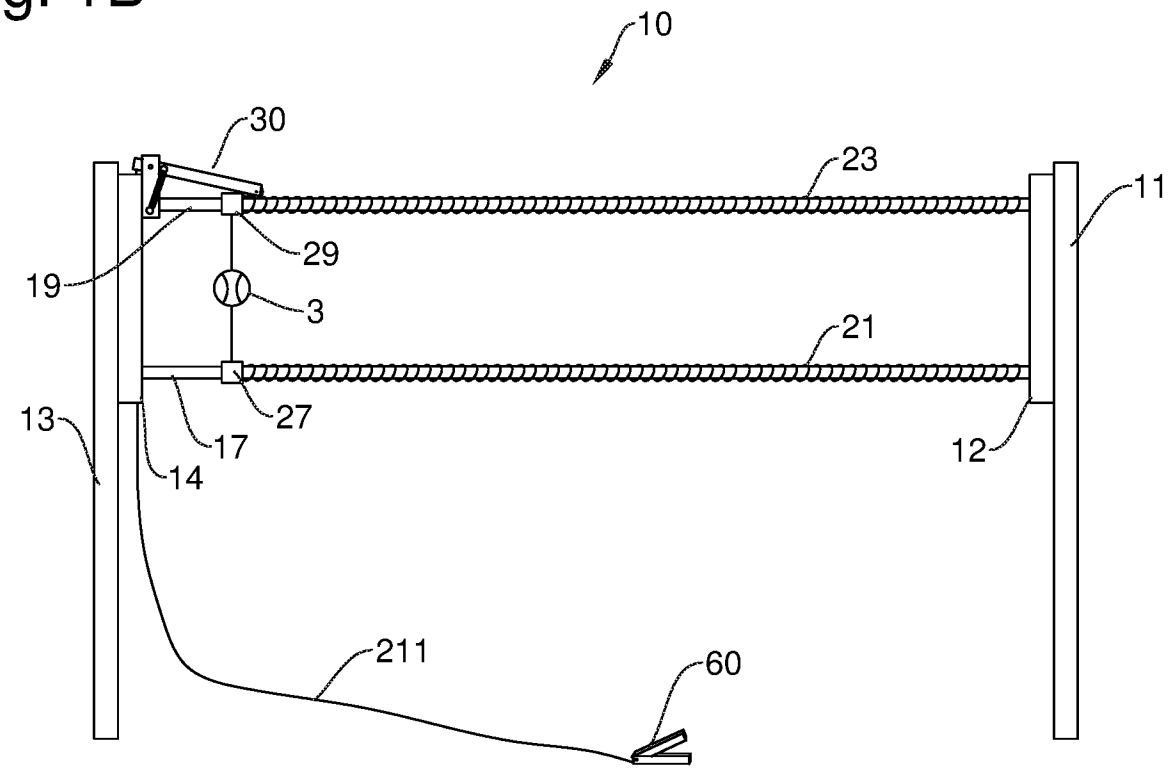
FIG. 1B is a side view showing the swing practice apparatus of the present invention where the baseball is positioned at an initial position.

An upper spring 23 connects the upper slide ring 29 and an end of the pitcher side of the upper horizontal bar 19. A lower spring 21 connects the lower slide ring 27 and an end of the pitcher side of the lower horizontal bar 17. Both the upper spring 23 and the lower spring 21 are tension (extension) strings which stretch as force is applied to them. The upper spring 23 and the lower spring 21 may be made of spring steel. When the baseball 3 is hit and moved to the pitcher side, the upper spring 23 and the lower spring 21 are stretched. The stopper 30 is provided at the pitcher side of the upper horizontal bar 19. FIG. 1B is a side view showing the swing practice apparatus 10 of the present invention shown in FIG. 1A, except that the baseball 3 is moved to the pitcher side by being hit by the user and stopped by the stopper 30. When the baseball 3 is hit to the pitcher side with sufficient force, the baseball 3 moves linearly along the upper and lower horizontal bars 19 and 17 due to the sliding movement of the upper slide ring 29 and the lower slide ring 27. The stopper 30 stops the baseball by engaging with the upper slider 29 as will be described later. There, the upper spring 23 and the lower spring 21 are elongated and store mechanical energy. When the stopper 30 is released, the baseball 3 will move toward the catcher side due to the upper spring 23 and the lower spring 21.

Figure 2C:
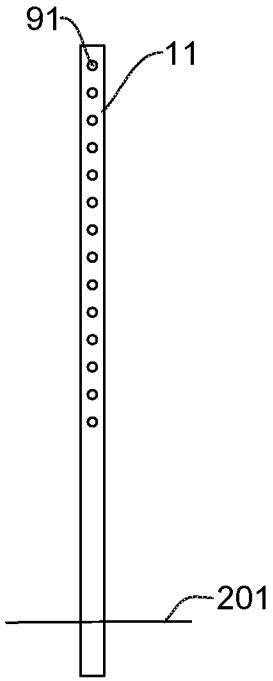
FIG. 2C is a front view of another embodiment of the pole where the bottom end of the pole is dug into the ground under the present invention.
Figure 2B:
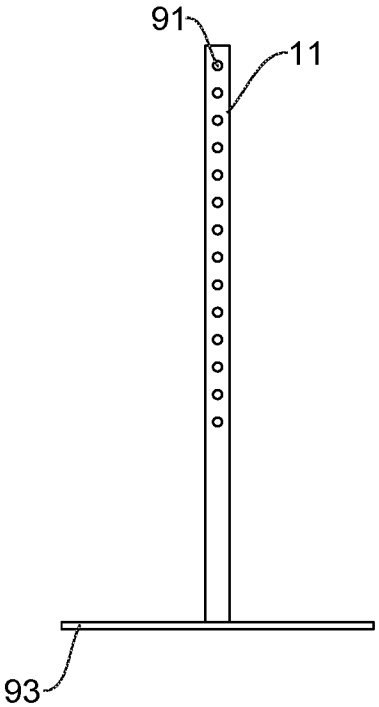
FIG. 2B is a front view of an embodiment of the pole where a base that touches the ground is provided at the bottom of the pole under the present invention.
Figure 2A:
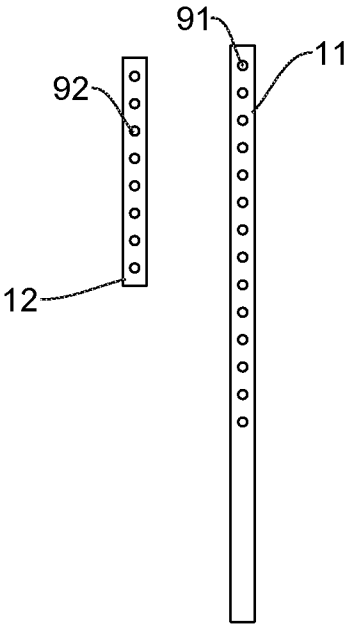
FIG. 2A is a front view of a pole of the swing practice apparatus and an attachment portion that attaches to the pole under the present invention.

FIG. 2A is a front view, as viewed in the direction shown by arrow 203 in FIG. 1A, of the pole 11 of the swing practice apparatus 10 and the attachment portion 12 that attaches to the pole 11. While not shown in FIG. 2A for simplicity, the attachment portion 12 attaches the upper horizontal bar 19 and the lower horizontal bar 17. The pole 11 has multiple screw holes 91. The attachment portion 12 also has multiple screw holes 92. The spacing between adjacent screw holes 91 is equal to the spacing between adjacent screw holes 92. The attachment portion 12 is fixed to the pole 11 by screws (not shown) inserted through the screw holes 92 and screw holes 91. The height of attachment portion 12 and the horizontal bars can be adjusted by selecting desired screw holes. Although not shown in the drawings, the pole 13 located at the pitcher side works with the attachment portion 12 in the same manner described above to be securely fixed with each other.

The FIG. 2B is a front view of an embodiment of the pole 11 where a base portion 93 that touches the ground is provided at the bottom of the pole 11. The base portion 93 makes contact with the ground to securely stand the swing practice apparatus 10. FIG. 2C is a front view of another embodiment of the pole 11 where the bottom end of the pole is dug into the ground 201 to stand the swing practice apparatus 10.

Figure 2E:
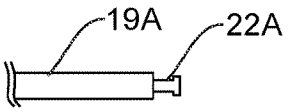
FIG. 2E illustrates an upper horizontal bar and a hook portion to be used for the pole shown in FIG. 2D.
Figure 2F:
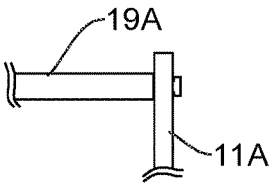
FIG. 2F illustrates the upper horizontal bar that is attached to the pole by means of the hook portion.
Figure 2D:
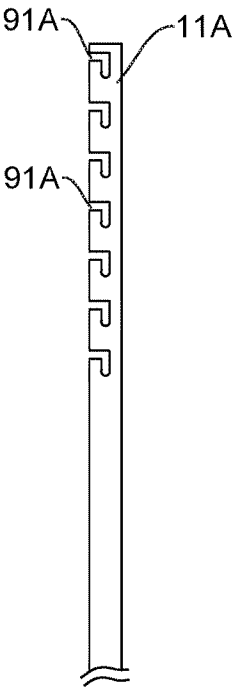
FIG. 2D is front view of another embodiment of a pole of the swing practice apparatus.

While the above embodiment uses screws to attach the horizontal bars to the pole, other arrangement may also be utilized. FIG. 2D to 2F show illustrations showing an embodiment example to the horizontal bars to the pole without using screws. FIG. 2D is a front view, as viewed in the direction shown by arrow 203 in FIG. 1A, of the pole 11A. The pole 11 has multiple hook receptors 91A. The hook receptors 91A is shaped like letter "L" rotated 180 degrees. FIG. 2E illustrates an upper horizontal bar 19A and a hook portion 22A. An end of the hook portion 22A attaches to an end of the upper horizontal bar 19A, and the other end of the hook portion 22A is shaped to be larger than the space of the hook receptor 91A. FIG. 2F shows an illustration of the upper horizontal bar 19A shown in FIG. 2E attached to the pole 11A by means of the hook portion 22A. Due to the shape of the hook receptors 91A, as shown in FIG. 2D, the hook portion 22A can be inserted from the left side of the hook receptor 91A and be securely held at the bottom of the hook portion 22A. Thus, under the embodiment shown in FIGS. 2D to 2F, the upper horizontal bar 19A is attached to the pole 11A without using a screw.

Figure 3A:
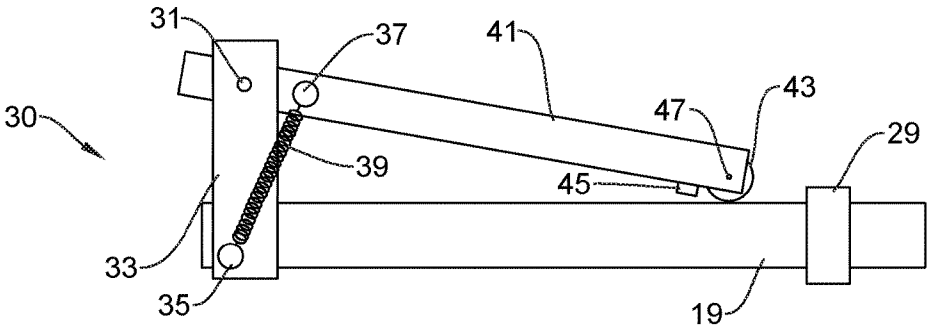
FIG. 3A is a side view showing a stopper of the present invention that attaches to an end of a horizontal bar at a moment when a ring that supports the baseball is not being stopped by the stopper.

The stopper 30 is described with reference to FIGS. 3A, 3B and 3C. FIG. 3A is a side view showing the stopper 30 that attaches to an end of the upper horizontal bar 19 at a moment when the slide ring 29 that supports the baseball 3 (not shown in FIG. 3A) is not being stopped by the stopper. The stopper 30 is securely attached to the upper horizontal bar 19 via a base pole 33 which stands vertically. An arm 41 is swingably connected to the base pole 33 with a support shaft 31 as an axis. An arm spring 39 is hooked to a base hook support 35 of the base pole 33 and to an arm hook support 37 of the arm 41. An end of the arm 41 is provided with a roller 43, which can rotate with a roller shaft 47 as an axis of rotation. A stopper protrusion 45 protrudes downward at a bottom near the roller shaft 47 of the arm 41. The arm spring 39 is a tension spring that pulls the arm 41 downward so that the roller 43 of the arm 41 makes contact with the upper horizontal bar 19.

Figure 3B:
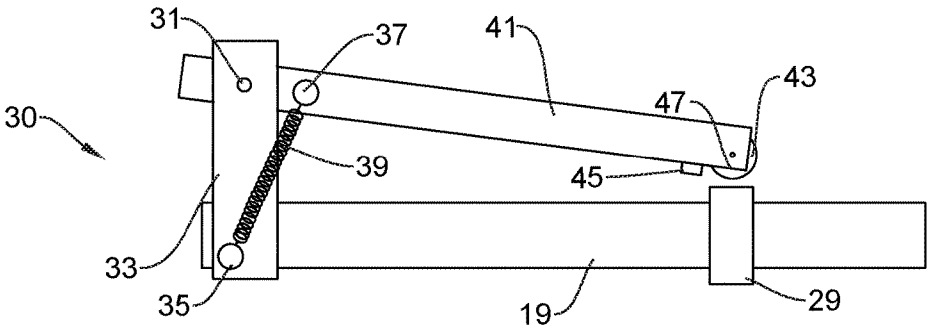
FIG. 3B is a side view showing the stopper of the present invention that attaches to an end of a horizontal bar at a moment when the ring that supports the baseball is about to be stopped by the stopper.

FIG. 3B is a side view showing the stopper 30 at a moment when the slide ring 29 that supports the baseball 3 is about to be stopped by the stopper 30. When the user hits the baseball 3 and baseball 3 moves in the direction shown in arrow 203 (to the pitcher side) of FIG. 1A, the slide ring 29 and the slide ring 27 move along the horizontal bars 19 and 17. The slide ring 29 makes a contact with the roller 43. Since the roller 43 can rotate with the roller shaft 47 as an axis of rotation, as the slide ring 29 moves along the upper horizontal bar 19 and hits the roller 43, the slide ring 29 is able to push up the end of the arm 41 upon impact. While the roller 43 is used in the above embodiment, any device that allows smooth entry of the upper slide ring 29 may also be used. For instance, a curved material with low friction may be used in stead of the roller 43.

Figure 3C:
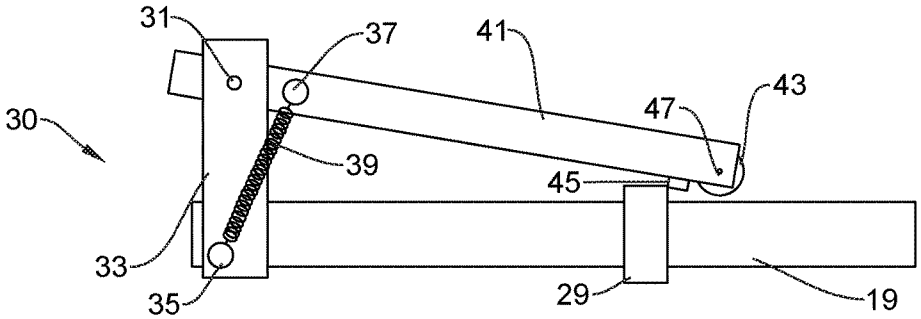
FIG. 3C is a side view showing the stopper of the present invention that attaches to an end of a horizontal bar at a moment when the ring that supports the baseball is being stopped by the stopper.

FIG. 3C is a side view showing the stopper 30 at a moment when the slide ring 29 that supports the baseball 3 is being stopped by the stopper. The stopper protrusion 45 makes a contact with an edge of the slide ring 29. The stopper protrusion 45 is preferably height-adjustable, such as a screw, so that the stopper protrusion 45 is able to optimally contact the slide ring 29 to stop the slide ring 29. Once the slide ring 29 passes the roller 43 and the stopper protrusion 45, the slide ring 29 will return to the initial position due to the force exerted by the upper spring 23 and the lower spring 21. The slide ring 29 is hooked by the stopper protrusion 45 since the end of the arm 41 moves downward due to gravity and the arm spring 39 that pulls the arm 41 downward. Thus, when the user hits the baseball 3 all the way to the stopper 30, the stopper 30 stops the slide ring 29 that supports the baseball 3. When the end of the arm 41 is moved upward by a release mechanism to be described later, the slide ring 29 is disengaged from the stopper protrusion 45. Due to the force exerted by the upper spring 23 and the lower spring 21, the slide ring 29 and the baseball 3 move back to the initial position. Thus, the user practicing the batting swing is able to hit the baseball 3 at an appropriate timing as the baseball moves toward the user. Since the baseball 3 moves to the catcher side as the user releases the stopper 30 at a desired timing, the user is able to simulate a batting practice for hitting a ball from the pitcher rather than hitting a stationary ball. While the stopper 30 is mounted only to the upper horizontal bar 19 in the above embodiment, the stopper 30 may be also mounted on the lower horizontal bar 17, or both the upper horizontal bar 19 and the lower horizontal bar 17.

Figure 4C:
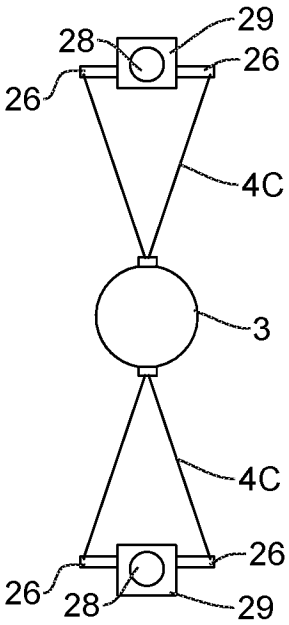
FIG. 4C is front view of still another embodiment of the baseball, the support strings that support the baseball, and the rings of the present invention.
Figure 4B:
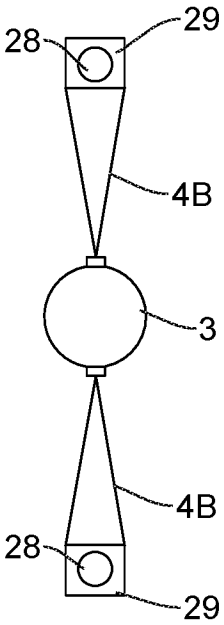
FIG. 4B is front view of another embodiment of the baseball, the support strings that support the baseball, and the rings of the present invention.
Figure 4A:
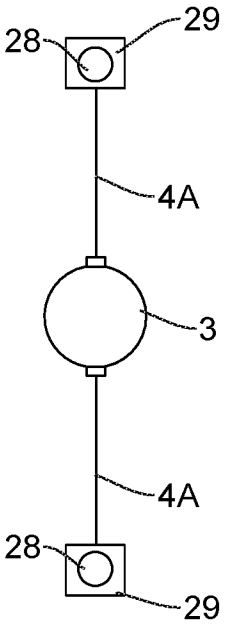
FIG. 4A is front view of an embodiment of the baseball, support strings that support the baseball, and rings of the present invention.

FIGS. 4A to 4C are schematic views showing the relationship and variants of the slide rings 27 and 29, the baseball 3, and support strings 4A, 4B and 4C. FIG. 4A shows one embodiment where the upper support string 4A attaches to a top of the baseball 3 and the upper slide ring 29, and the lower support string 4A attaches to a bottom of the baseball 3 and the lower slide ring 27. Slide holes 28 are provided to both the upper slide ring 29 and the lower slide ring 27. The slide holes 28 are designed to be smoothly slidable for the circumference of the horizontal bars 19 and 17.

FIG. 4B shows another embodiment where the baseball is supported by four lines of the support strings 4B. Two lines of the upper support strings 4B extend from the top of the baseball 3 to the upper ring 29, and two lines of the lower support strings 4B extend from the bottom of the baseball 3 to the lower ring 27. The width between the support strings 4B is arranged to be wider at the upper ring 29 and the lower ring 27 than at the baseball 3. Having multiple strings to support the baseball 3 allows the upper and lower slide rings 29 and 27 to move smoothly along the horizontal bars 19 and 17. FIG. 4C shows another embodiment similar to the embodiment shown in FIG. 4B, except that support wings 26 are provided to the slide rings 27 and 29. The support wings 26 serve to widen the width between the support strings 4C, which contribute to stabilize the baseball 3 and allows upper and lower slide rings 29 and 27 to move smoothly along the horizontal bars 19 and 17.

Figure 5B:
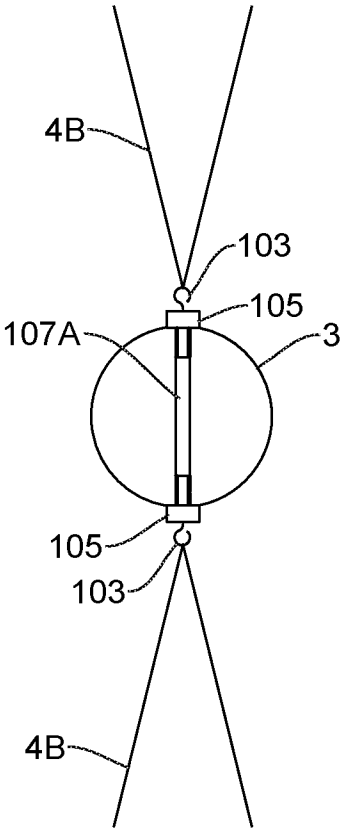
FIG. 5B is an illustration of another embodiment of the baseball supported by wires showing cross-sectional view of the baseball in the present invention.
Figure 5A:
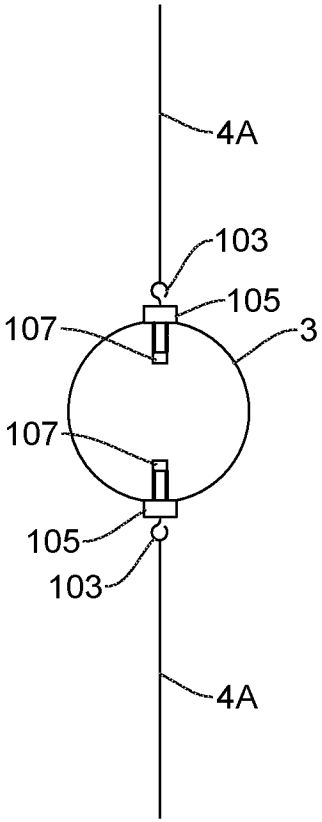
FIG. 5A is an illustration of an embodiment of the baseball supported by wires showing cross-sectional view of the baseball in the present invention.

FIG. 5A shows an embodiment example of a detailed view of how the support strings are attached to the baseball 3 under the present invention. A screw hole 107 is provided to the baseball 3, the nut 105 engages with the screw hole 107 by being fastened to the screw hole 107. The hook 103 is connected to the nut 105. The support string 4A attaches to the hook 103. FIG. 5B shows another embodiment example of a detailed view of how the support strings are attached to the baseball 3 under the present invention. In this embodiment, the screw hole 107A is provided to penetrate through the baseball 3. The nut 105 engages with the screw hole 107 to be tightened. The hook 103 is connected to the nut 105. Two lines of the support string 4B attach to one hook 103 similar to the case illustrated in FIG. 4B. The support springs are preferably made of stranded wire ropes.

Figure 6B:
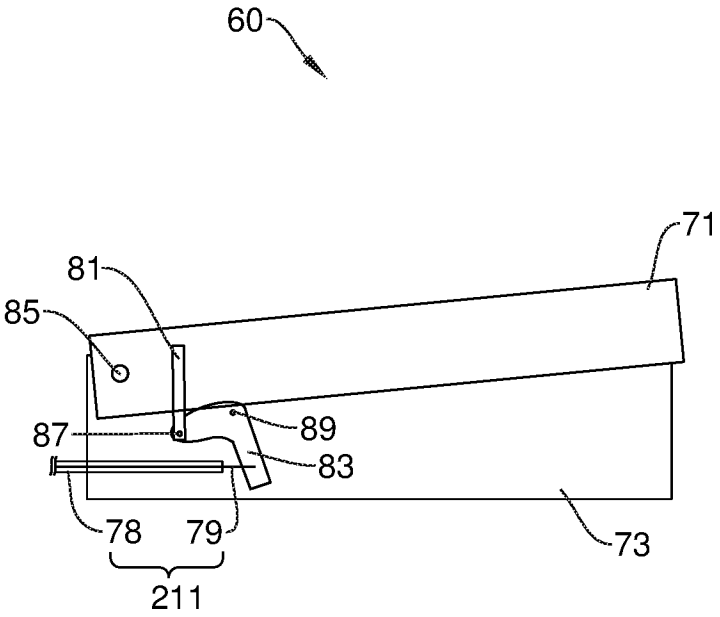
FIGS. 6A and 6B are schematic views of a mechanical foot pedal that can be used as a release mechanism to release the stopper in the present invention.
Figure 6A:
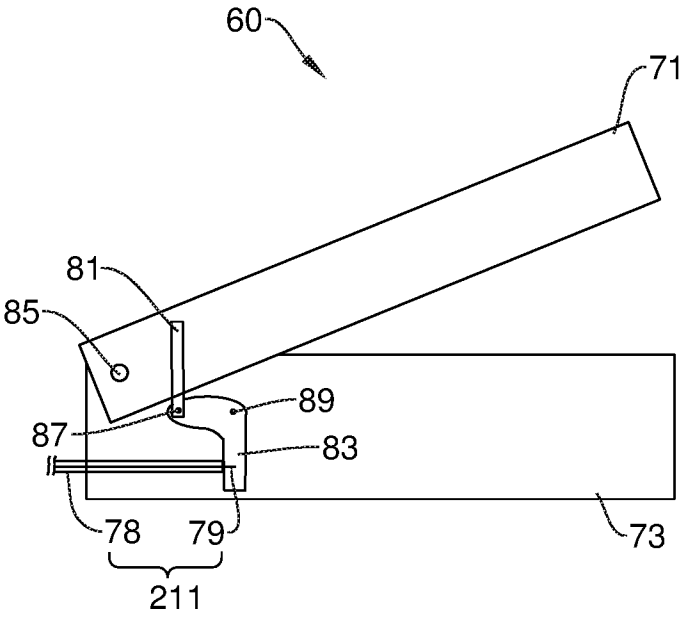

FIGS. 6A and 6B show schematic views of a mechanical foot pedal 60 that can be used as a release mechanism to release the stopper 30. The mechanical foot pedal 60 shown in FIGS. 6A and 6B is shown as a simplified schematic representation showing the inner structure to pull a pull string 79. The pull string 79 is a foot-actuated string that transmits force to the stopper 30. In FIG. 6A, the mechanical foot pedal 60 has a pedal 71 and a base 73. The pedal 71 is swingable by a hinge 85. A drive rod 81 connects to the pedal 71 and to a drive arm 83. An end of a pull string 79 is connected to the drive arm 83. The pull string 79 is covered by a flexible sheathing 78. The pull string 79 and the flexible sheathing 78 are collectively called a cable 14. The cable 14 connects to the stopper 30 to release the stopper when the user applies force to the pedal 71. FIG. 6B shows the mechanical foot pedal 60 in a condition where the pedal 71 is pressed. The drive 81 is pushed downward, which applies force to a rod connector shaft 87. As the drive arm 83 is rotatably fixed at a drive arm shaft 89, the end of the drive arm 83 connected to the pull string 79 is moved so that the pull string is pulled. The stopper will release the baseball 3 since the pull string 79 is connected to the stopper 30. More specifically, when the end of the arm 41 of the stopper is moved upward by the pull string 79, the slide ring 29 is disengaged from the stopper protrusion 45. Any other means for transmitting linear movement in a flexible sheathing may also be used as a release mechanism to release the stopper 30. The stopper 30 may alternatively be released by an electric timer that releases the stopper 30 in a fixed time interval, such as 10 to 20 seconds.

Figure 7B:
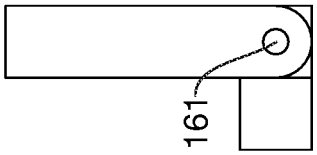
FIG. 7B is a top view showing the hinge portion swung to one side.
Figure 7C:
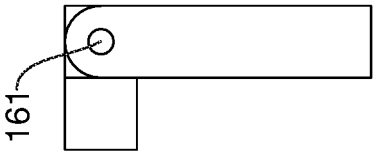
FIG. 7C is a top view showing the hinge portion swung to the opposite side.
Figure 7A:
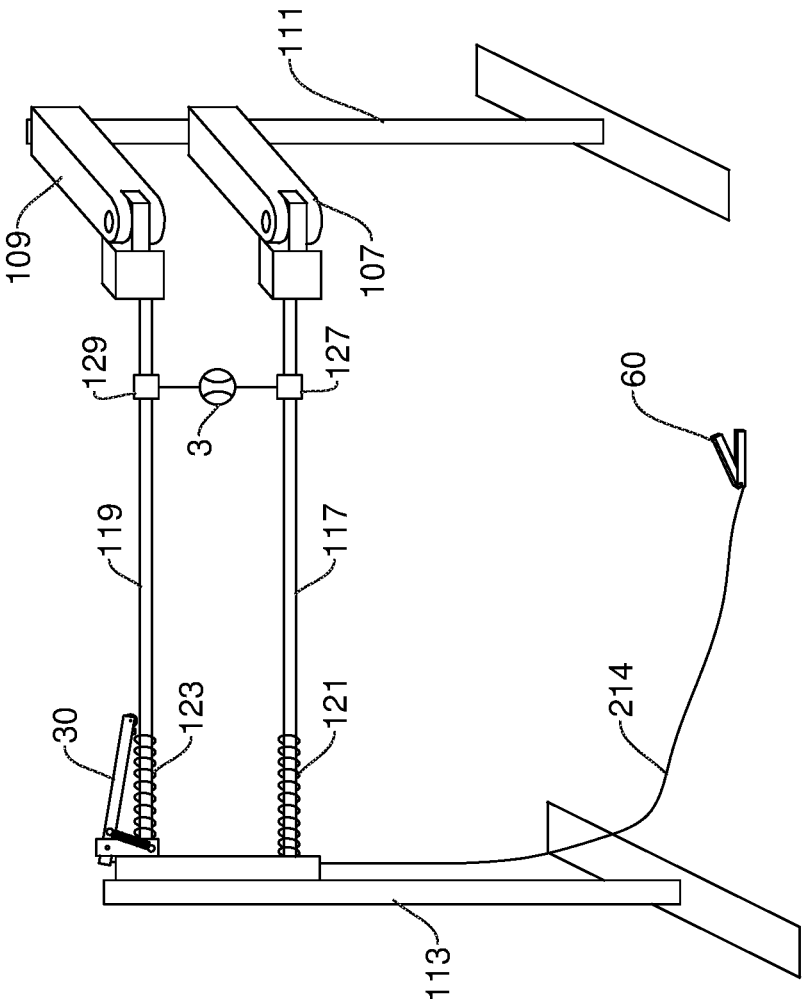
FIG. 7A is a side view showing another embodiment of the swing practice apparatus of the present invention where hinge portions are attached at back ends of the horizontal bar.

An alternative embodiment implementing the same principal of the present invention is shown in FIG. 7A. The swing practice apparatus 110 shown in FIG. 7A is characterized in that one end of upper horizontal bar 119 and the lower horizontal bar 117 closer to the initial position of the baseball 3 (catcher side) are provided with an upper pivot arm 109 and a lower pivot arm 107. The baseball 3 is supported by the upper slide ring 129 and the lower slide ring 127.

The pivot arm 107 or 109 has a pivot shaft 161. The pivot arms 107 and 109 can be turned 180 degrees with the pivot shaft 161 as an axis as shown the top views in FIGS. 7B and 7C. The bending of the pivot arms 109 and 107 shown in FIG. 7A are equivalent to the bending of the pivot arm shown in FIG. 7B, which is suitable for a right-handed batter. When a left-handed batter uses the swing practice apparatus 110, the pivot arms 109 and 107 are bent in the same way as shown in FIG. 7C. Thus, the pivot arms 109 and 107 are designed to rotate along a horizontal plane by 180 degrees to accommodate both the right-handed and the left-handed batters.

Instead of the upper spring 23 and lower spring 21 shown in FIGS. 1A and 1B, an upper spring 123 and a lower spring 121 are provided at an end of the horizontal bars 117 and 119 closer to the stopper 30. Unlike the upper spring 23 and lower spring 21 that are tension springs, the upper spring 123 and the lower spring 121 are compression springs that get shorter as the load is applied to them. When the user hits the ball 3 and the slide ring supporting the ball 3 is stopped by the stopper 30, the user is able to release the stopper by pressing the foot pedal 60 in the similar manner described above. As the stopper 30 is released, the baseball 30 will move toward the user (to the catcher side) due to the force exerted by the upper spring 123 and the lower spring 121. In the alternative, it is possible to arrange tension springs in the same manner as the swing practice apparatus 10 shown in FIGS. 1A and 1B. Moreover, it is also possible to provide an additional means to pull the baseball 3 toward the catcher side. For example, it is possible to connect an end of a wire to either one of the upper slide ring 129 or the lower slide ring 127, and the other end of the wire to a load, which acts to pull the slide ring toward the catcher side by its weight.

The pivot arms 109 and 107 allow the swing practice apparatus 110 to take less space than the swing practice apparatus 10. For example, the length of the upper horizontal bar 119 and the lower horizontal bar 117 of the may be about 3 feet as opposed to 5 or 6 feet for the horizontal bars 19 and 17 for the swing apparatus 10 that does not utilize the pivot arms 109 and 107. Remaining components of the swing practice apparatus 110 are arranged in the similar manner as the swing practice apparatus 10 shown in FIGS. 1A and 1B.

Figure 8A:
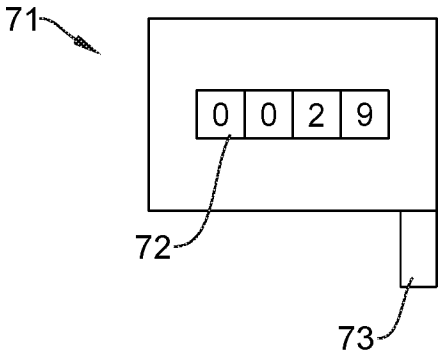
FIG. 8A is an illustration of a counter that can be installed on the swing practice apparatus of the present invention.
Figure 8B:
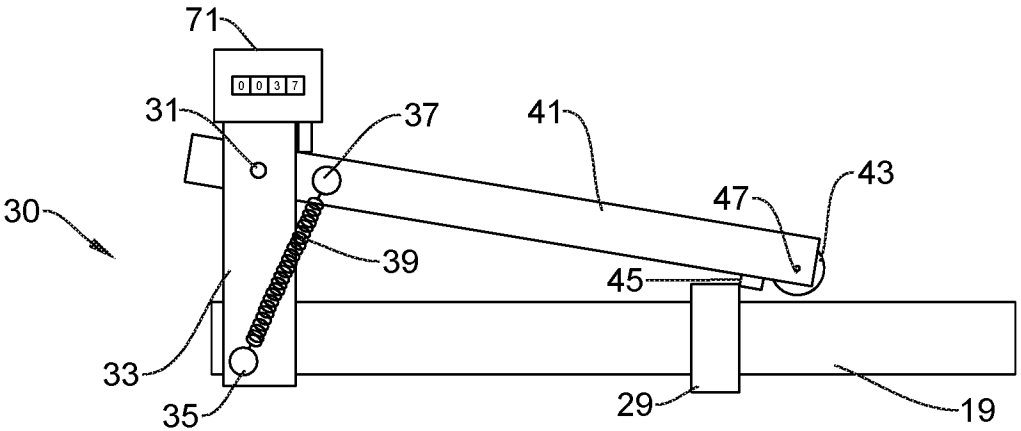
FIG. 8B is an illustration of the counter attached to the stopper of the swing practice apparatus of the present invention.

FIG. 8A is an illustration of a counter that can be implemented to the swing practice apparatus of the present invention. The counter can count the number that the user hit the baseball 3. The counter 71 shown in FIG. 8A has the button 72 and the display 73. While the counter 71 in FIG. 8A is a mechanical counter, other types of counter, such as electronic, or electro-mechanical counters may be used as well. FIG. 8B is an illustration similar to FIG. 3C, except that the counter 71 is mounted to the stopper 30. The stopper 30 is securely attached to the upper horizontal bar 19 via the base pole 33. The counter 71 is attached on the base pole 33. The button 72 of the counter 71 is arranged to be pushed by the arm 41 when the arm 41 swings upward as the baseball 3 is hit and the slide ring 29 and move along the horizontal bars 19 to make a contact with the roller 43. As the button 72 is pressed, the number shown on the display 73 will be incremented by one to count the number of hitting, which allows the user to keep record of the practice and improves user's motivation. When the stopper 30 is released, the button 72 is not effectuated since the movement of the arm 41 is smaller than the movement when the baseball 3 is hit. Other placement of the counter 71 may also be used to count the number of hitting. For instance, the counter 71 may be placed so that the button 72 is pressed by the slide ring 29 rather than by the swing arm 41.

Although the swing practice apparatus is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A swing practice apparatus comprising:

an upper horizontal bar;

a lower horizontal bar that is positioned directly under the upper horizontal bar and runs parallel with the upper horizontal bar;

an upper slide ring capable of sliding along the upper horizontal bar;

a lower slide ring capable of sliding along the lower horizontal bar;

a ball supported from the upper slide ring and the lower slide ring via support springs, and positioned between the upper horizontal bar and the lower horizontal bar;

a spring that exserts force to the ball is positioned toward a catcher side of the upper and lower horizontal bars;

a stopper mounted at a pitcher side of the upper horizontal bar to stop the upper slide ring; and a release mechanism to release the stopper which causes the upper slide ring to be released from the stopper and the upper slide ring and the ball to move toward the catcher side due to the spring;

wherein the pitcher side refers to the side toward which the baseball is hit and the catcher side refers to the opposite side.

2. The swing practice apparatus of claim 1, further comprising a pole connected to one end of the upper horizontal bar and the lower horizontal bar, and an opposing pole connected to the other end of the upper horizontal bar and the lower horizontal bar.

3. The swing practice apparatus of claim 1, wherein the ball is supported by a string extended from the upper slide ring and a string extended from the lower slide ring.

4. The swing practice apparatus of claim 3, wherein the ball is supported by two lines of strings extended from the upper slide ring and two lines of strings extended from the lower slide ring.

5. The swing practice apparatus of claim 1, wherein the spring is a tension spring.

6. The swing practice apparatus of claim 1, wherein the spring is a compression spring.

7. The swing practice apparatus of claim 1, wherein the stopper comprises:

a base pole that stands vertically and attaches to the upper horizontal bar;

an arm swingably connected to the base pole with a support shaft as an axis;

a rotatable roller provided at an end of the arm;

a stopper protrusion protruding at a bottom near the roller of the arm; and an arm spring connected to the arm and pulls the arm downward;

wherein the stopper protrusion hooks the upper slide ring to stop the ball.

8. The swing practice apparatus of claim 1, further comprising a release mechanism to release the stopper that enables the ball to move to the catcher side.

9. The swing practice apparatus of claim 1, wherein the release mechanism is a mechanical foot pedal having a foot pedal-actuated cable that pulls the arm of the stopper.

10. The swing practice apparatus of claim 1, further comprising a counter having a button and a display, wherein the button is activated in response to the arm of the stopper to count the number of hitting the ball.

11. The swing practice apparatus of claim 1, further comprising:

an upper pivot arm connected at a pitcher side of the upper horizontal arm; and a lower pivot arm connected at a pitcher side of the lower horizontal arm, wherein the upper pivot arm and the lower pivot arm are rotatable along a horizontal plane.

* * * * *